United States Patent [19]

Hattori et al.

[11] Patent Number: 4,730,811

[45] Date of Patent: Mar. 15, 1988

[54] HEAT TREATMENT APPARATUS WITH A FLUIDIZED-BED FURNACE

[75] Inventors: Hisashi Hattori; Hidemitsu Takenoshita; Yoichiro Hanada; Tohru Fukuda, all of Hirakata, Japan

[73] Assignee: Kabushiki Kaisha Komatsu Seisakusho, Tokyo, Japan

[21] Appl. No.: 896,783

[22] Filed: Aug. 15, 1986

[30] Foreign Application Priority Data

Aug. 20, 1985 [JP] Japan ..... 60-126004[U]
Dec. 6, 1985 [JP] Japan ..... 60-273525

[51] Int. Cl.[4] ..... C21D 11/00

[52] U.S. Cl. ..... 266/81; 266/87; 266/90; 266/252; 266/259

[58] Field of Search ..... 266/252, 249, 259; 432/58, 197; 266/81, 87, 90

[56] References Cited

U.S. PATENT DOCUMENTS 3,197,328 7/1965 Jung et al. ..... 266/252

FOREIGN PATENT DOCUMENTS 2440994 7/1980 France ..... 266/252
55-8533 1/1980 Japan .
57-60015 4/1982 Japan .
57152417 9/1985 Japan .

OTHER PUBLICATIONS

Procedure, "Features of Fluid Hearth Atmosphere Furnace Systems", date unknown.

*Primary Examiner*—Christopher W. Brody
*Attorney, Agent, or Firm*—Armstrong, Nikaido, Marmelstein & Kubovcik

[57] ABSTRACT

A heat treatment apparatus for metals or metal articles has a fluidized-bed furnace for heating the metals and a cooling chamber disposed above the furnace so as to communicate with a heating chamber of the furnace through a partition capable of being opened and closed, so that the metals can be cooled immediately after heated. The apparatus further includes a circulating circuit arrangement with a heat-resisting fan for circulating together or separately heated furnace gas and cooling fluid. Flow rate of the circulating furnace gas and/or cooling fluid is controlled by a flow rate control device provided in the circulating circuit.

7 Claims, 5 Drawing Figures

HEAT TREATMENT APPARATUS WITH A FLUIDIZED-BED FURNACE

BACKGROUND OF THE INVENTION

1. Field of the Invention

This invention relates to a heat treatment apparatus for metals or metal articles, and more particularly to a heat treatment apparatus comprising a fluidized-bed furnace, and a gas cooling chamber disposed above the fluidized-bed furnace, and a circuit arrangement for circulating together or separately the heated furnace gas in the fluidized-bed furnace and the cooling fluid in the gas cooling chamber, and wherein heating and cooling are effected continuously.

2. Description of the Prior Art

A conventional heat treatment apparatus using a fluidized-bed furnace as a heating furnace is disclosed in, for example, Japanese Laid-Open-To-Public Specification No. 57-152417. According to this specification, there is disclosed a heat treatment furnace having a pair of independent heat treatment furnaces for high and low temperature uses installed in juxtaposition, and arranged such that the furnace gas discharged from the high temperature furnace is allowed to pass through heat exchange pipes mounted in the low temperature furnace so as to conduct heat exchange with the fluidized-bed inside the low temperature furnace, and is then pressurized by means of a fan to allow it to circulate again into the high temperature furnace. This conventional type heat treatment apparatus is intended to achieve the reuse of waste heat and exhaust gases, and also aims at stabilization of the furnace gas in the heat treatment apparatus for high temperature use; that is, the volume and composition of gases in the furnace. This conventional heat treatment apparatus, however, needs to operate always both the high and low temperature furnaces at the same time, since if only the high temperature furnace is operated the furnace gas kept at a high temperature is drawn into the furnace gas circulating fan without conducting heat exchange thus causing a damage of the fan by the high temperature furnace gas. Therefore, it is uneconomical not to use both the high and low temperature furnaces at the same time.

Moreover, a further conventional heat treatment furnace is well-known, which uses a vacuum furnace as a heat treatment furnace utilized for bright hardening or bright quenching, bright annealing and bright tempering of steels, and for sintering of metals. In this heat treatment apparatus, however, since heat treatment is conducted under a vacuum condition, a special discharge device and a vacuum container etc. are required, and so the apparatus per se becomes necessarily large in size and expensive in cost. Further, this type of heat treatment apparatus is also disadvantageous in that when cooling the heat-treated articles, thermally insulated walls and door of the furnace need to be cooled at the same time which results in deteriorated heat efficiency at the time of reheating. The heat treatment apparatus using a vacuum furnace is still further disadvantageous in that, in the respect of heat treatment performance aspect, articles are subjected to non-uniform heat treatment, and it takes sometimes a long time to conduct heat treatment.

SUMMARY OF THE INVENTION

The present invention has been devised to eliminate the above-mentioned disadvantages of the prior art apparatus, and its first object is to provide a heat treatment apparatus which enables metals or metal articles to be heated and thereafter cooled continuously by providing a fluidized-bed furnace with a cooling chamber disposed above the furnace so as to communicate with a heating chamber of the furnace through a partition capable of being opened and closed.

Another object of the present invention is to provide a heat treatment apparatus which enables the apparatus to achieve stabilization of the furnace gas and reuse of exhaust gas components and sensible heat by the provision of a circulating circuit arrangement for circulating together or separately the heated furnace gas in the fluidized-bed furnace and the cooling fluid in the cooling chamber.

A still further object of the present invention is to provide a heat treatment apparatus which enables a temperature in the fluidized-bed furnace to be kept in uniform by the provision of a flow rate control device adapted to control flow rate of circulating furnace gas and/or cooling fluid as well as that of treating gas supplied into the furnace in response to a temperature signal transmitted by a temperature detector mounted in the furnace.

To achieve the above-mentioned objects, according to a first aspect of the present invention, there is provided a heat treatment apparatus for metals, including a fluidized-bed furnace for heating use in which a fluidized-bed comprised of refractory particles is accommodated; and a cooling chamber disposed above the fluidized-bed furnace through a partition capable of being opened and closed freely and which is arranged to cool immediately the articles which have been subjected to heat treatment in the fluidized-bed furnace.

According to a second aspect of the present invention, there is provided a heat treatment apparatus as set forth in the first aspect, further including a circulating circuit means provided with a heat-resisting fan for circulating together the heated furnace gas in the fluidized-bed furnace and the cooling fluid in the cooling chamber; and a heat-treating gas supply means connected to the circulating circuit means upstream of the heat-resisting fan so as to supply selectively a predetermined heat-treating gas into the fluidized-bed furnace.

According to a third aspect of the present invention, there is provided a heat treatment apparatus as set forth in the first aspect, further including a first circulating circuit means provided with a heat-resisting fan for circulating the heated furnace gas in the fluidized-bed furnace; a second circulating circuit means provided with a fan for circulating the cooling fluid in the cooling chamber; and a heat-treating gas supply means connected to the first circulating circuit means upstream of the heat-resisting fan so as to supply selectively a predetermined heat-treating gas into the fluidized-bed furnace.

According to a fourth aspect of the present invention, there is provided a heat treatment apparatus as set forth in the second aspect, further including a flow rate controller arrangement connected to the circulating circuit means in the vicinity of the heat-resisting fan so as to control the flow rates of the circulating furnace gas and cooling fluid and that of the heat-treating gas to be supplied.

According to a fifth aspect of the present invention, there is provided a heat treatment apparatus as set forth in the third aspect, further including a flow rate controller arrangement connected to the first circulating circuit means connected in the vicinity of the heat-resisting fan so as to control the flow rates of the furnace gas and the heat-treating gas.

According to a sixth aspect of the present invention, there is provided a heat treatment apparatus as set forth in the second and third aspects wherein the heat-treating gas supply means includes at least one furnace gas detector; and a furnace gas atmosphere controller adapted to control the feed volume of a predetermined heat-treating gas in response to a detection signal transmitted by the furnace gas detector.

According to a seventh aspect of the present invention, there is provided a heat treatment apparatus as set forth in the fourth and fifth aspects wherein the flow rate controller arrangement comprises a temperature detector adapted to detect the temperature in the furnace and generate a temperature signal as an output; a flow rate controller adapted to generate a control signal as an output in response to the temperature signal transmitted by the temperature detector; a bypass circuit connected to the furnace gas circulating circuit means at two places upstream and downstream thereof in the vicinity of the heat-resisting fan; and a flow control valve installed in the bypass circuit and having a variable orifice or restrictor controlled by the control signal transmitted by the flow controller, and wherein the heat-resisting fan is driven by an electric motor.

According to a eighth aspect of the present invention, there is provided a heat treatment apparatus as set forth in the fourth and fifth aspects wherein the flow rate controller arrangement comprises a temperature detector adapted to detect the temperature in the furnace and generate a temperature signal as an output; a flow rate controller adapted to generate a control signal as an output in response to the temperature signal transmitted by the temperature detector; a turbine adapted to be driven or rotated by a high pressure fluid; a conduit for supplying the high pressure fluid to rotate the turbine; and a flow control valve installed in the high pressure fluid supply conduit and having a variable orifice or restrictor controlled by a control signal transmitted by the flow rate controller, and wherein the heat-resisting fan is driven by the turbine.

The above and many other advantages, features and additional objects of the present invention will become apparent to those versed in the art upon making reference to the following detailed description and accompanying drawings in which preferred structural embodiments incorporating the principles of the present invention are shown by way of illustrative example.

DETAILED DESCRIPTION OF THE PREFERRED EMBODIMENTS

The first embodiment of the heat treatment apparatus according to the present invention will now be described in detail below with reference to FIG. 1.

Figure 1:
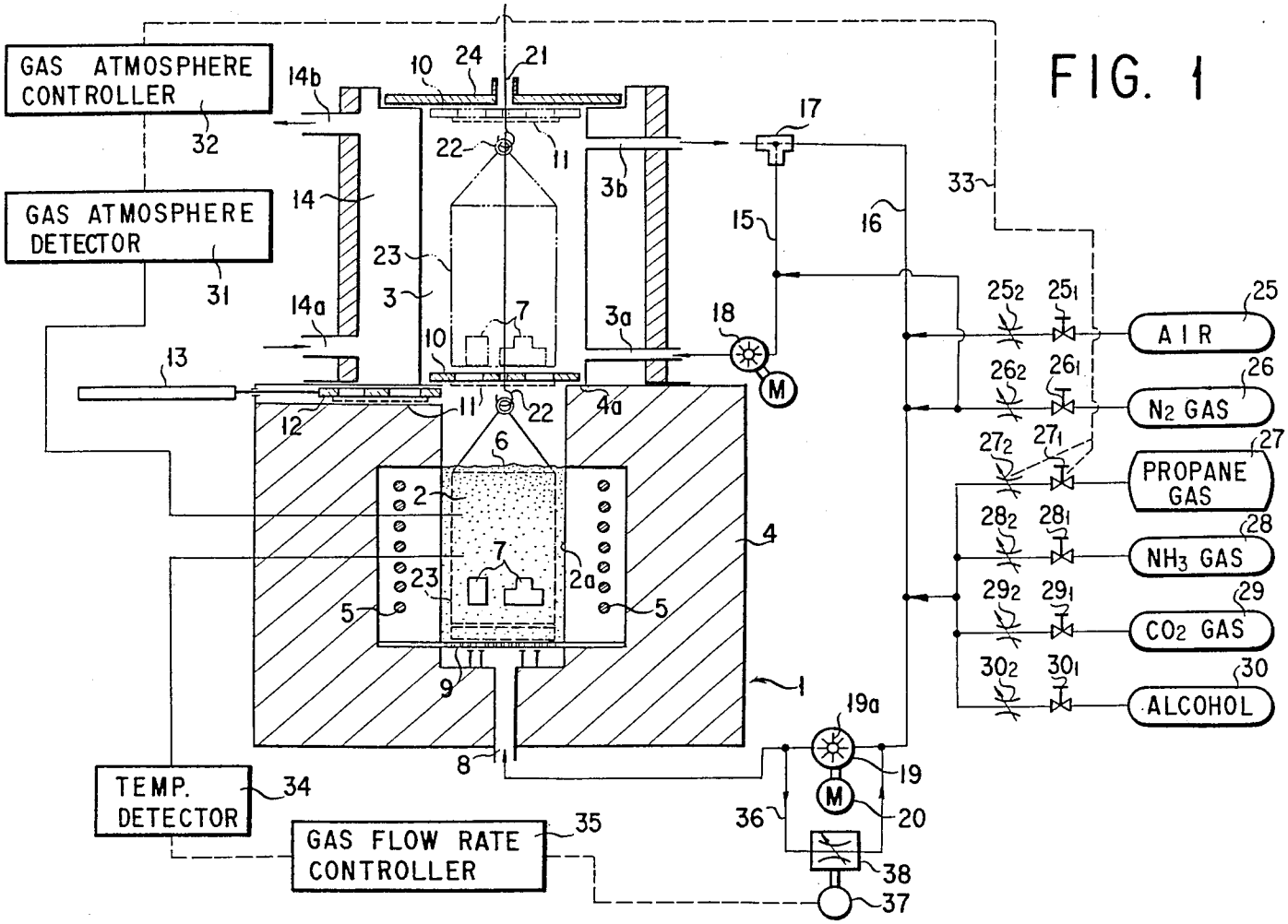
FIG. 1 is a partially sectional, schematic explanatory view showing generally one embodiment of the heat treatment apparatus according to the present invention including a fluidized-bed furnace.

Referring to FIG. 1, reference numeral 1 denotes a body of the heat treatment apparatus which comprises a fluidized-bed furnace 2 (referred to merely as "heating chamber" hereinbelow) for heat treatment of metals disposed in the lower part thereof, and a cooling chamber 3 disposed in the upper part thereof.

The above-mentioned heating chamber 2 has a retort 2*a* whose periphery is surrounded by a thermal insulation material 4. A heater 5 such as, for example, an electric heater or a gas burner or the like is installed in the periphery of the retort 2*a* so that metal articles 7 to be treated may be heated through a fluidized-bed 6 comprised of refractory particles such as alumina particles or zirconium particles or the like.

Connected to the bottom of the above-mentioned heating chamber 2 is a gas inlet passage 8, arranged to supply air into the heating chamber 2 in the course of raising the temperature of the fluidized-bed 6 and supply a treating gas such as, for example, $N_2$ gas or mixture of $N_2$ and $NH_3$ gases or the like therein during the heat treatment. The air or treating gas will flow through a perforated gas dispersion plate 9 into the fluidize-bed 6 to fluidized and heat the latter.

The cooling chamber 3 is provided above the heating chamber 2, and the inside diameter of the chamber 3 is slightly larger than that of the chamber 2. A stepped portion 4*a* is formed between the heating chamber 2 and the cooling chamber 3. In the stepped portion 4*a* there is provided a second elevating door 10 adapted to block, during heating process, the upper opening of the heating chamber, and a ceramic filter 11 is provided under the door 10. Further, a sliding door 12 is provided which blocks the upper opening of the heating chamber 2 during the process of cooling articles 7 which have been in the fluidized-bed 6. The sliding door 12 is arranged to be slidably moved by means of an actuator 13 such as a hydraulic or pneumatic cylinder. A ceramic filter 11 is located under the sliding door 12. Further, the outer periphery of the cooling chamber 3 is surrounded by a cooling jacket 14 so that, during cooling process, air or water may flow through an inlet 14*a* into the jacket 14 to cool the inside of the cooling chamber 3 and then the air or water which has flowed through the jacket 14 may be discharged through an outlet 14*b* formed in the upper part thereof.

Further, during the cooling process, $N_2$ gas is allowed to flow through a gas inlet 3*a* into the cooling chamber 3 so as to cool the articles 7 which have been heated and the $N_2$ gas which has flown through the inside of the cooling chamber 3 is allowed to discharge through a gas outlet 3*b* formed in the upper part thereof, and then return to the gas inlet 3*a* again through a first circulating passage 15 or alternatively the discharged gas is supplied through a second circulating passage 16 and then through the gas inlet passage 8 into the heating chamber 2.

A directional control valve 17 is installed in the branched part of the first and second circulation passages 15 and 16. Further, a fan 18 is installed in the first circulation passage 15, whilst a heat-resisting fan 19 driven by an electric motor 20 at a constant rotational speed is installed in the second circulating passage 16. Further, the heat-resisting fan has a blade wheel 19*a* formed by a heat-resisting material such as, for example, INCONEL alloy or ceramic material or the like.

Whilst, articles 7 to be subjected to heat treatment are accommodated in a heat-resisting bucket 23 to be suspended by a heat-resisting hook 22 through a heat-resisting chain 21. The bucket 23 accommodating the articles 7 which is suspended by the chain 21 is lowered from the opening in the upper part of the cooling chamber 3 through the latter into the fluidized-bed 6 in the heating chamber 2 and is accommodated therein. The heat-resisting chain 21 passes through the central part of a first elevating door 24 adapted to block the upper opening of the cooling chamber 3 and that of the second elevating door 10. When the bucket 23 is suspended and accommodated in the heating chamber 2, the upper opening of the cooling chamber 3 is blocked by the first elevating door 24, and that of the heating chamber 2 is blocked by the second elevating door 10.

Further, air, $N_2$ gas, propane gas, $NH_3$ gas, $CO_2$ gas and alcohol supply sources 25, 26, 27, 28, 29 and 30 are connected to the upstream side of the heat-resisting fan 19 installed in the second circulating passage 16 through valves $25_1$, $26_1$, $27_1$, $28_1$, $29_1$ and $30_1$, and variable orifices or restrictors $25_2$, $26_2$, $27_2$, $28_2$, $29_2$ and $30_2$. The $N_2$ gas supply source 20 is further connected to the upstream of the fan 18 installed in the first circulation passage 15.

Further, the valve 271 and the variable restrictor $27_2$ of the propane gas supply source 27 are connected to a gas atmosphere control arrangement which consists of a gas atmosphere detector 31 adapted to detect the gas atmosphere in the heating chamber 2 and thereby generate a signal as an output; a gas atmosphere controller 32 adapted to generate a gas atmosphere control signal as an output in response to the signal transmitted by the gas atmosphere detector 31; and a circuit 33 for transmission of the control signal so that the degree of opening of each of the valve $27_1$ and the restrictor $27_2$ may be controlled. As for the above-mentioned gas detector 31, at least one of an infra-red ray analyzer and $O_2$ gas sensor may be used, but it is preferable to use both of them.

When the articles 7 are subjected to a heat treatment such as nitriding or carburizing, etc., it is important to stabilize the gas atmosphere in the heating chamber 2 and also maintain uniformly or stabilize the temperature in the heating chamber 2; that is, the temperature in the furnace.

Figure 3:
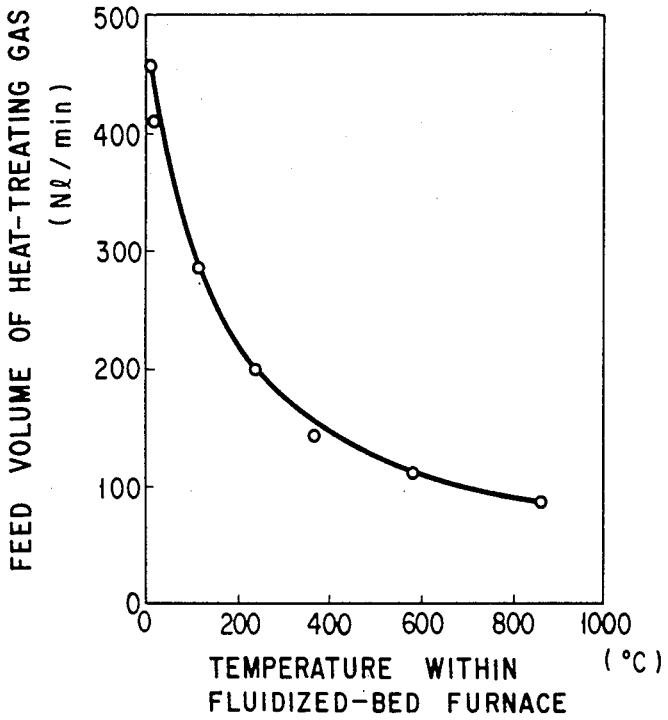
FIG. 3 is a diagram showing the relationship between the temperature in the fluidized-bed furnace and the supply or feed volume of a heat-treating gas.

To maintain the temperature in the heating chamber 2 always constant, it is necessary to control the flow rate of the furnace gas circulated and supplied again through the second circulating passage 16 and the inlet passage 8 together with the newly mixed treating gas into the heating chamber 2. For example, in case of a heat treatment apparatus wherein a furnace having a retort 2*a* whose diameter is 40 cm includes a fluidized-bed comprised of alumina particles whose size is 80 mesh, the feed volume (Nl/min) of treating gas for fluidizing the fluidized-bed is as shown by a diagram in FIG. 3; that is, with the increase in the temperature in the fluidized-bed furnace, the volume of the treating gas required to be fed will reduce in accordance with Charles's Law. Thus, in order to keep the temperature in the whole heating chamber 2 uniform, it is required to supply a predetermined volume of the gas into the furnace.

In the heat treatment apparatus of the present invention, there is provided a gas flow rate controller arrangement for obtaining a stabilized furnace gas which comprises a furnace gas temperature detector 34 such as a thermocouple or the like adapted to detect the temperature in the heating chamber 2 and generate a temperature signal as an output; a gas flow rate controller 35 adapted to generate a control signal as an output in response to the temperature signal transmitted by the temperature detector; a bypass circuit 36 connected to the second circulating passage 16 at two places, upstream and downstream of the heat-resisting fan 19 and in vicinity of the latter; and a flow control valve 38 having a variable orifice or restrictor whose swash plate is controlled by an actuator 37 driven in response to a control signal transmitted by the gas flow rate controller 35. This flow rate controller arrangement serves to control the flow rate of the circulating furnace gas including the treating gas to be supplied through the second circulating passage 16 into the heating chamber 2 thereby achieving stabilization of the furnace gas in the heating chamber 2.

Further, the control of the flow rate of the furnace gas can be achieved by regulating the number of rotations of the drive motor 20 for the heat-resisting fan 19; however, in that case, provision of a frequency converter is required thus making the arrangement expensive.

Next, the operation of one embodiment of the heat treatment apparatus according to the present invention will be described.

When the articles 7 are subjected to heat treatment, air is first fed into the heating chamber 2 under the condition the sliding door 12 is closed so as to fluidize the fluidized-bed 6, and then the latter is heated by activating the heater 5. After the refractory particles forming the fluidized-bed 6 is removed by means of the ceramic filter 11, the heated furnace gas which has fluidized the fluidized-bed 6 is discharged through the cooling chamber 2. However, the heated furnace gas may be circulated again into the heating chamber 2 by means of a heat-resisting fan or the like.

When the fluidized-bed 6 has reached a predetermined temperature, the bucket 23 accommodating the articles 7 to be subjected to heat treatment is lowered through the upper opening of the cooling chamber 3 and then through the latter into the heating chamber so as to be suspended therein. When the bucket 23 has reached inside the cooling chamber 3, the first elevating door 24 through which the heat-resisting chain 21 passes is moved down to shut off the upper opening of the cooling chamber 3. Subsequently, when the bucket 23 has been accommodated in the heating chamber 2, the second elevating door 10 through which the heat-resisting chain 21 passes is moved to close the upper opening of the heating chamber 2.

Subsequently, in order to prevent oxidization of the articles 7 to be subjected to heat treatment, the valve $26_1$ is opened to supply $N_2$ gas by means of the heat-resisting fan 19 into the heating chamber 2 through the second circulating passage 16 and the gas inlet passage 8 thereby purging the air present in the heat treatment apparatus. Subsequently, a desired treating gas is fed into the heating chamber 2 so that the articles 7 may be subjected to heating treatment by the heated fluidized-bed.

After the refractory particles have been removed by the ceramic filter 11, the gas served to fluidize the fluidized-bed 6 is discharged through a plurality of throughholes formed in the second elevating door 10 into the cooling chamber 3. At that time, since the upper opening of the cooling chamber 3 is blocked by the first elevating door 24, the exhaust gas is not allowed to be released into the atmosphere. Further, the entry of the surrounding air into the cooling chamber 3 is also prevented.

Upon completion of the heat treatment of the articles 7, $N_2$ gas for cooling is introduced from the inlet 3*a* into the cooling chamber 3 to cool the articles 7 and the bucket 23 while the bucket 23 is being lifted into the cooling chamber 3 and to blow off or remove the refractory particles deposited on the bucket 23. After that, the bucket 23 is lifted into the cooling chamber 3, and then $N_2$ gas is allowed to circulate therethrough while the sliding door 12 is closed to cool the articles 7 subjected to heat treatment in the cooling chamber 3. In case of cooling the articles 7 quickly, air or water is supplied into the cooling jacket 14 at the same time.

Upon completion of cooling of the articles 7, the bucket 23 accommodating the articles is lifted from the cooling chamber for withdrawal of the articles 7.

Further, in the above-mentioned one embodiment, the capacity of the heat-resisting fan 19 is designed to produce a gas discharge flow rate of 1000 Nl/min and a discharge pressure ranging from 1000 to 3000 mm/Aq. When hardening of a die steel plate 30 mm thick was made by means of this heat-treatment apparatus, the heat treatment was completed in one hour and forty-five minutes which includes 45 minutes for heating time and one hour for cooling time. Therefore, as compared with 3 hour on average needed for the conventional heat treatment apparatus, the time required for heat treatment could be reduced markedly.

The operation of the heat treatment apparatus of the present invention for the articles to be subjected to various heat treatments will be described below.

In case the articles 7 are heated without causing oxidization thereof, the valve $\mathbf{26}_1$, is opened to supply $N_2$ gas from the $N_2$ gas supply source 26 into the heating chamber 2 at a flow rate of 1 to 7 Nl per minute under the condition the heating chamber 2 is heated to and maintained at a temperature of 400° to 1000° C. Further, when the first and second elevating doors 10 and 24 are opened to charge the articles 7 in the fluidized-bed 6, $N_2$ gas is supplied into the heat-resisting fan 19 at a flow rate of 100 to 150 Nl per minute to prevent the air from being drawn into the fan 19. At the time of commencement of $N_2$ gas supply too, $N_2$ gas is supplied into the fan 19 at a flow rate of 100 to 150 Nl per minute for the period of 20 seconds to one minute for the same purpose. Subsequently, $N_2$ gas is supplied at a flow rate of 1 to 7 Nl per minute. In case low temperature treatment is made, the supply volume of $N_2$ gas needs to be increased.

The foregoing treatment procedure is applicable to heating without causing oxidization; however in case of nitriding treatment, after the heating chamber 2 has been heated to a temperature of 450° to 700° C., $N_2$ gas is supplied into the heating chamber 2 in the same manner as the above-mentioned case of heating without causing oxidization to thereby purge the air present in the heating chamber 2 and the circulating passages. While the air purge using $N_2$ gas is being made, a valve $\mathbf{28}_1$ is opened to supply ammonia gas from an ammonia supply source 28 into the heating chamber 2 at a flow rate of 5 to 30 Nl per minute.

Further, in case of nitro-carburizing treatment, concurrently with the above-mentioned operation, a valve $\mathbf{29}_1$ is opened to supply carbon dioxide gas from a carbon dioxide gas supply source 29 into the heating chamber 2 at a flow rate of 0.5 to 3 Nl per minute for about one minute.

In case of oxynitriding treatment, a valve $\mathbf{25}_1$ is opened to supply air into the heating chamber 2 at rate of 0.5 to 3 Nl per minute.

Whilst, in case of carburizing treatment, $N_2$ gas is supplied into the heating chamber 2 to purge the air therein, and then a valve $\mathbf{30}_1$ is opened to supply alcohol from an alcohol supply source 30 into the chamber 2 at a flow rate of 2 to 20 l per hour, and further the valve $\mathbf{27}_1$ is opened to supply propane gas from the propane gas supply source 27 into the heating chamber 2 at a flow rate ranging from 0 to 3 Nl per minute. At that time, by regulating the flow rate of propane gas by the aforementioned flow rate controller arrangement, the carburizing atmosphere in the heating chamber 2 can be varied and automatically controlled.

In case of carbo-nitriding treatment, the valve $\mathbf{28}_1$ is opened additionally to supply ammonia gas into the heating chamber 2 at a flow rate of 1 to 5 Nl per minute.

Further, it is to be noted that the above-mentioned Nl indicates the volume of gas at a temperature of 15° C. and at a pressure of one atom.

Figure 2:
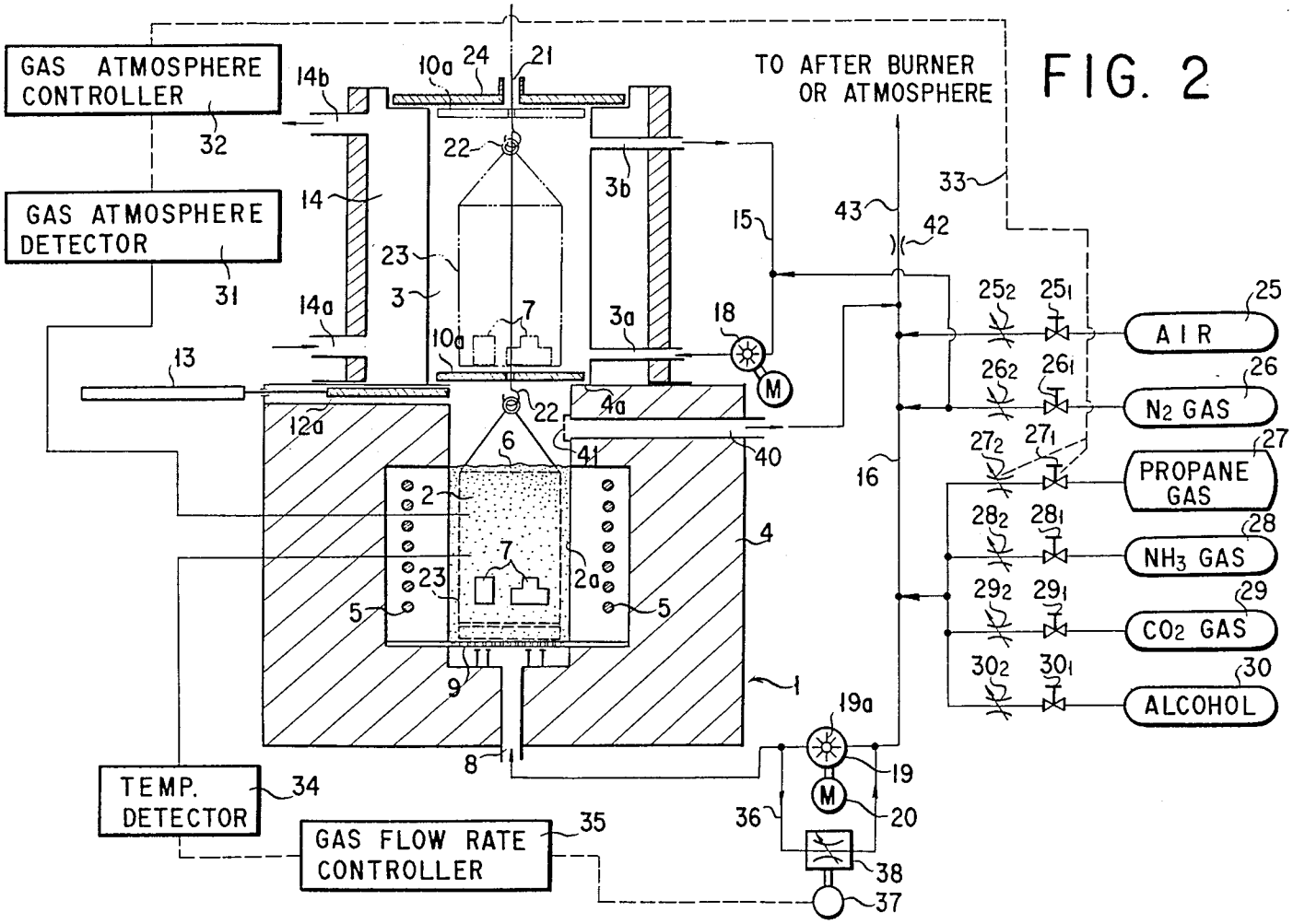
FIG. 2 is a partially sectional, schematic explanatory view showing generally another embodiment of the heat treatment apparatus according to the present invention.

The second embodiment of the present invention will now be described below with reference to FIG. 2. In FIG. 2, the component parts designated by the same reference numerals and the same reference characters as those used in the aforementioned first embodiment shown in FIG. 1 are identical ones having the same functions, and therefore the explanation of them is omitted herein to avoid duplication.

This second embodiment differs from the first embodiment in the following points. Stating in brief, according to the second embodiment shown in FIG. 2, the arrangement is made such that the furnace gas in the heating chamber 2 is discharged through a discharge passage 40 perforated in the furnace wall 4, without passing through the inside of the cooling chamber 3. Stating in more detail, the furnace gas utilized to fluidize the fluidized-bed 6 and subject the articles 7 to heat treatment is allowed to pass through a ceramic filter 41 mounted in the exit port of the discharge passage 40 so as to remove the refractory particles and thereby enable only the gas component to be discharged through the discharge passage 40 into the circulating passage 16. Thus, the $N_2$ gas for cooling and the furnace gas are allowed to circulate independently through the first and second circulating passages 15 and 16, respectively.

Therefore, in the second embodiment, a second elevating door 10*a* and a sliding door 12*a* do not need provision of air vent holes, and also provision of ceramic filters under them.

Further, connected to the upper end of the second circulating passage 16 is an exhaust gas pipe 43 which leads in turn through a restrictor 42 to an after-burner not shown or to the atmosphere.

According to this second embodiment, the $N_2$ gas for cooling use and the heated exhaust gas are allowed to circulated independently with each other so that the heat treatment can be made at a higher thermal efficiency.

Figure 4:
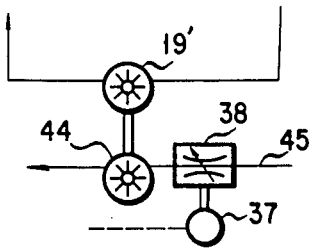
FIG. 4 is a fragmentary explanatory view showing another embodiment of the flow rate controller arrangement for controlling flow rates of the furnace gas, the heat-treating gas and/or the cooling fluid.

Further, FIG. 4 shows another embodiment of the flow rate controller arrangement. According to this flow rate controller arrangement, a heat-resisting fan 19' is arranged to be driven by a turbine 44 adapted to be rotated by the action of high pressure air. The control of the flow rate of gas delivered by the heat-resisting fan 19 can be achieved by controlling the actuator 37 as in the case of the first embodiment to regulate the variable restrictor in the flow rate controller arrangement 38 installed in a high pressure supply conduit 45 and on the upstream side of the turbine 44.

Figure 5:
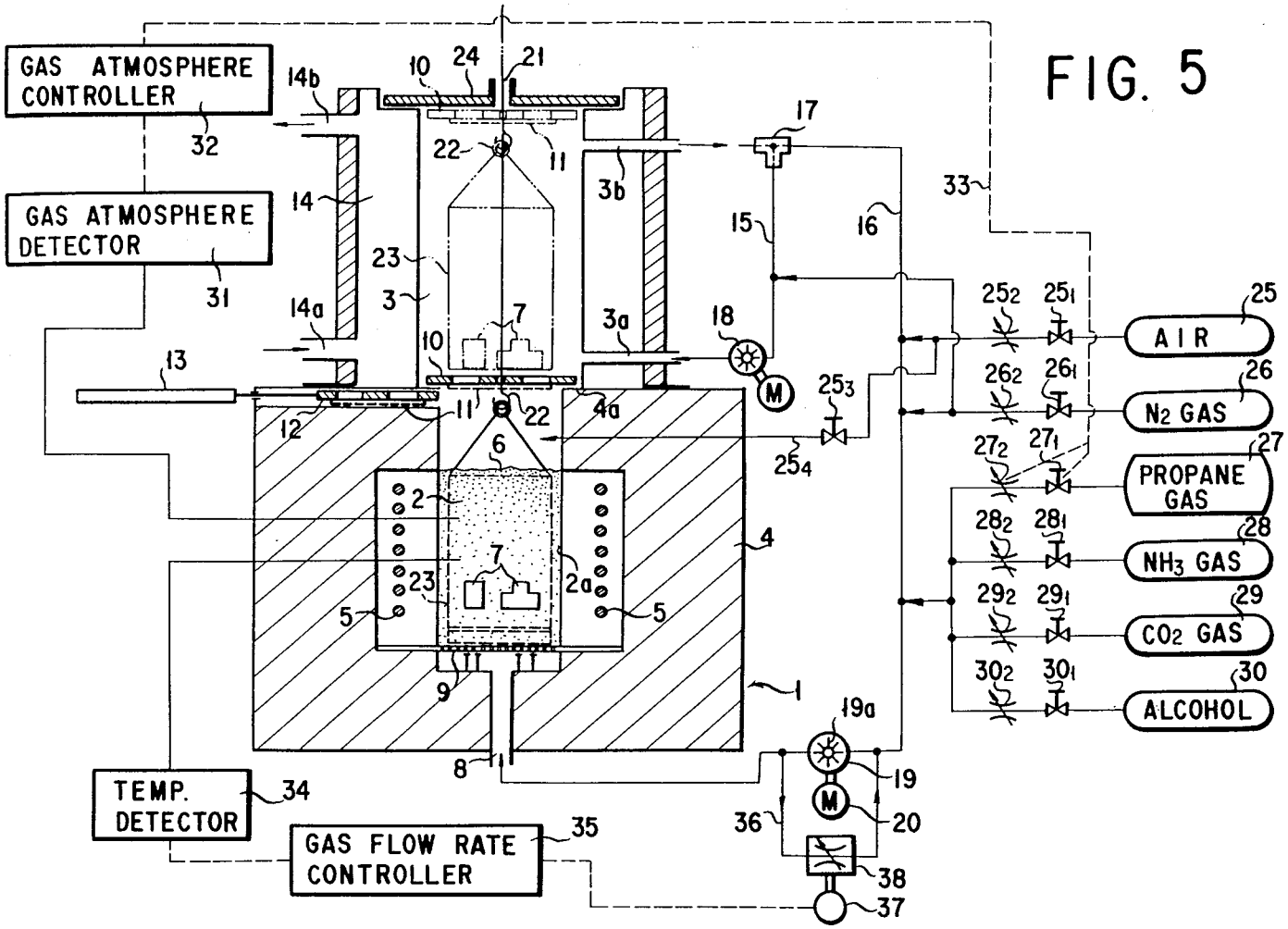
FIG. 5 is a partially sectional, schematic explanatory view showing generally a still another embodiment of the heat treatment apparatus according to the present invention.

In FIG. 5, there is shown a fifth embodiment of the heat treatment apparatus according to the present invention. According to this third embodiment, the arrangement is made such that the air delivered from the air supply source 25 through the valve $\mathbf{25}_1$ and the restrictor $\mathbf{25}_2$ can be supplied through a branch pipe $\mathbf{25}_4$ having another valve $\mathbf{25}_3$ installed therein directly into the upper part of the heating chamber 2. This arrangement is intended to blow off the soot carried by the treating gas and deposited on the inner periphery of the retort 2*a* by the high pressure air to thereby clean the retort 2*a*, and aims in particular at removing the soot deposited on the surfaces of the ceramic filters 11 thereby eliminating possible difficulties with the discharge and circulation of the furnace gas.

While FIG. 5 shows the heat treatment apparatus according to the first embodiment shown in FIG. 1 which is provided with a device for introducing high pressure air for removing soot, it is needless to say that a similar device may be installed in the second embodiment shown in FIG. 2.

It is to be understood that the foregoing description is merely illustrative of the preferred embodiments of the present invention and that the scope of the invention is not to be limited thereto. Additional modification or alterations of the invention will readily occur to one skilled in the art without departing from the scope of the invention.

We claim:

1. A heat treatment apparatus for metals, comprising a fluidized-bed furnace for heating use in which a fluidized bed comprised of refracting particles is accomodated therein; a cooling chamber disposed above said fluidized-bed furnace through a partition capable of being opened and closed freely and which is arranged to cool immediately the articles which have been subjected to heat treatment in said fluidized-bed furnace; a circulating circuit means provided with a heat-resisting fan for circulating together the heated furnace gas in the fluidized-bed furnace and the cooling fluid in the cooling chamber; a heat-treating gas supply means connected to said circulating circuit means upstream of the heat-resisting fan so as to supply selectively a predetermined heat-treating gas into the fluidized-bed furnace; and, a flow rate controller arrangement connected to said circulating circuit means in the vicinity of said heat-resisting fan so as to control the flow rate of the circulating furnace gas and cooling fluid and that of the heat-treating gas to be supplied.

2. The heat treatment apparatus as claimed in claim 1, wherein said circulating circuit means comprises a first circulating circuit means provided with said heat-resisting fan for circulating the heated furnace gas in the fluidized-bed furnace, and a second circulating circuit means provided with a fan for circulating the cooling fluid in said cooling chamber.

3. The heat treatment apparatus as claimed in claim 1 wherein said heat-treating gas supply means includes at least one furnace gas detector; and a furnace gas atmosphere controller adapted to control the feed volume of a predetermined heat-treating gas in response to a detection signal transmitted by the furnace gas detector.

4. The heat treatment apparatus as claimed in claim 2 wherein said heat-treating gas supply means includes at least one furnace gas detector; and a furnace gas atmosphere controller adapted to control the feed volume of a predetermined heat-treating gas in response to a detection signal transmitted by the furnace gas detector.

5. The heat treatment apparatus as claimed in claim 1, characterized in that said flow rate controller arrangement comprises a temperature detector adapted to detect the temperature in the furnace and generate a temperature signal as an output; a flow rate controller adapted to generate a control signal as an output in response to the temperature signal transmitted by the temperature detector; a bypass circuit connected to the furnace gas circulating circuit means at two places upstream and downstream thereof in the vicinity of the heat-resisting fan; and a flow control valve installed in the bypass circuit and having a variable orifice or restrictor controlled by the control signal transmitted by the flow rate controller, and wherein said heat-resisting fan is driven by an electric motor.

6. The heat treatment apparatus as claimed in claim 1, characterized in that said flow rate controller arrangement comprises a temperature detector adapted to detect the temperature in the furnace and generate a temperature signal as an output; a flow rate controller adapted to generate a control signal as an output in response to the temperature signal transmitted by the temperature detector; a turbine adapted to be driven or rotated by a high pressure fluid; a conduit for supplying the high pressure fluid to rotate the turbine; and a flow control valve installed in the high pressure fluid supply conduit and having a variable orifice or restrictor controlled by the control signal transmitted by the flow rate controller, and wherein said heat-resisting fan is driven by said turbine.

7. The heat treatment apparatus as claimed in claim 1, further comprising a high pressure air supply means adapted to supply high pressure air through a valve directly into the upper part of said fluidized-bed furnace for heating use.

* * * * *